US005953940A

United States Patent [19]

Ling

[11] Patent Number: 5,953,940

[45] Date of Patent: Sep. 21, 1999

[54] EASILY OPERABLE COMBINATION PADLOCK

[76] Inventor: Chong-Kuan Ling, C/O Sinox Co., Ltd. P. O. Box 96-156, Taipei, Taiwan

[21] Appl. No.: 09/063,629

[22] Filed: Apr. 20, 1998

[51] Int. Cl.[6] ..... E05B 37/06

[52] U.S. Cl. ..... 70/25; 70/20; 70/315; 70/312

[58] Field of Search ..... 70/20, 22, 24, 70/25, 286, 287, 291, 294, 301, 304, 312, 315, 316, 318, 323, 26

[56] References Cited

U.S. PATENT DOCUMENTS

| | | | |
|---|---|---|---|
| 3,256,723 | 6/1966 | Lehman | 70/25 |
| 3,388,572 | 6/1968 | Morin | 70/25 |
| 3,983,724 | 10/1976 | Foote | 70/25 |
| 4,047,406 | 9/1977 | Foote | 70/25 |
| 4,343,164 | 8/1982 | Bako | 70/318 |
| 4,998,422 | 3/1991 | Borgmann et al. | 70/384 |
| 5,005,384 | 4/1991 | Lo et al. | 70/25 |
| 5,125,248 | 6/1992 | Ling | 70/312 |
| 5,592,837 | 1/1997 | McBride | 70/38 A |

FOREIGN PATENT DOCUMENTS

| | | | |
|---|---|---|---|
| 3125033 | 1/1983 | Germany | 70/25 |
| 2229220 | 9/1990 | United Kingdom | 70/315 |

*Primary Examiner*—Steven Meyers
*Assistant Examiner*—Teri Pham

[57] ABSTRACT

An easily operable combination padlock includes: a casing, a shackle having a long leg member and a short leg member respectively lockable with a pair of locking shuttles slidably held in the casing, a plurality of dials and sleeves rotatably mounted on a bolt longitudinally held in the casing, a conical head portion formed on a top of the bolt tangentially engageable with the two shuttles, and a combination-changing device formed on a bottom portion of the bolt and the casing for resetting a new combination when the padlock is unlocked; whereby upon an outward extending of the two shuttles as urged by the conical head portion of the bolt to engage the two leg members of the shackle, the shackle is locked for locking the padlock; and upon unlocking of the padlock, the conical head portion on the bolt is downwardly depressible without retarding an inward retraction of the two shuttles, the shackle will be upwardly pulled by retracting the shuttles for unlocking the padlock.

1 Claim, 6 Drawing Sheets

2
211
61
1
51
72
62
50
71
6
721
7
711
5
221
53
3
52
43
4

2
51
41
31
1
4
4
P
50
71
R
710
6
18
7
72
5
3
44
55
52
4
44
54

EASILY OPERABLE COMBINATION PADLOCK

BACKGROUND OF THE INVENTION

A conventional combination padlock as shown in FIGS. 8, 9 includes: a shackle S having a ring G circumferentially formed on a shackle leg member to be locked by a locking block L slidably held in a housing H (FIG. 8). Upon unlocking of the padlock by rotating the dials D and sleeves C rotatably held on a bolt B for a correct combination, a push button T is depressed (FIG. 9) to push a follower plate F to retract the locking block L, thereby allowing the shackle ring G to pass through a hole O formed in the locking block L for unlocking the padlock.

However, for further locking the padlock, the push button T should be always depressed by a user's fingers to retract the shackle to allow the shackle ring G to be obstructed under the locking block L as shown from FIG. 9 to FIG. 8, causing inconvenience for the user.

The present inventor has found the drawbacks of the conventional padlock and invented the present combination padlock easily locked and unlocked.

SUMMARY OF THE INVENTION

The object of the present invention is to provide an easily operable combination padlock including: a casing, a shackle having a long leg member and a short leg member respectively lockable with a pair of locking shuttles slidably held in the casing, a plurality of dials and sleeves rotatably mounted on a bolt longitudinally held in the casing, a conical head portion formed on a top of the bolt tangentially engageable with the two shuttles, and a combination-changing device formed on a bottom portion of the bolt and the casing for resetting a new combination when the padlock is unlocked; whereby upon an outward extending of the two shuttles as urged by the conical head portion of the bolt to engage the two leg members of the shackle, the shackle is locked for locking the padlock; and when the conical head portion on the bolt is downwardly depressible without retarding an inward retraction of the two shuttles, the shackle will be upwardly pulled by inwardly retracting the shuttles for unlocking the padlock.

DETAILED DESCRIPTION

Figure 1:
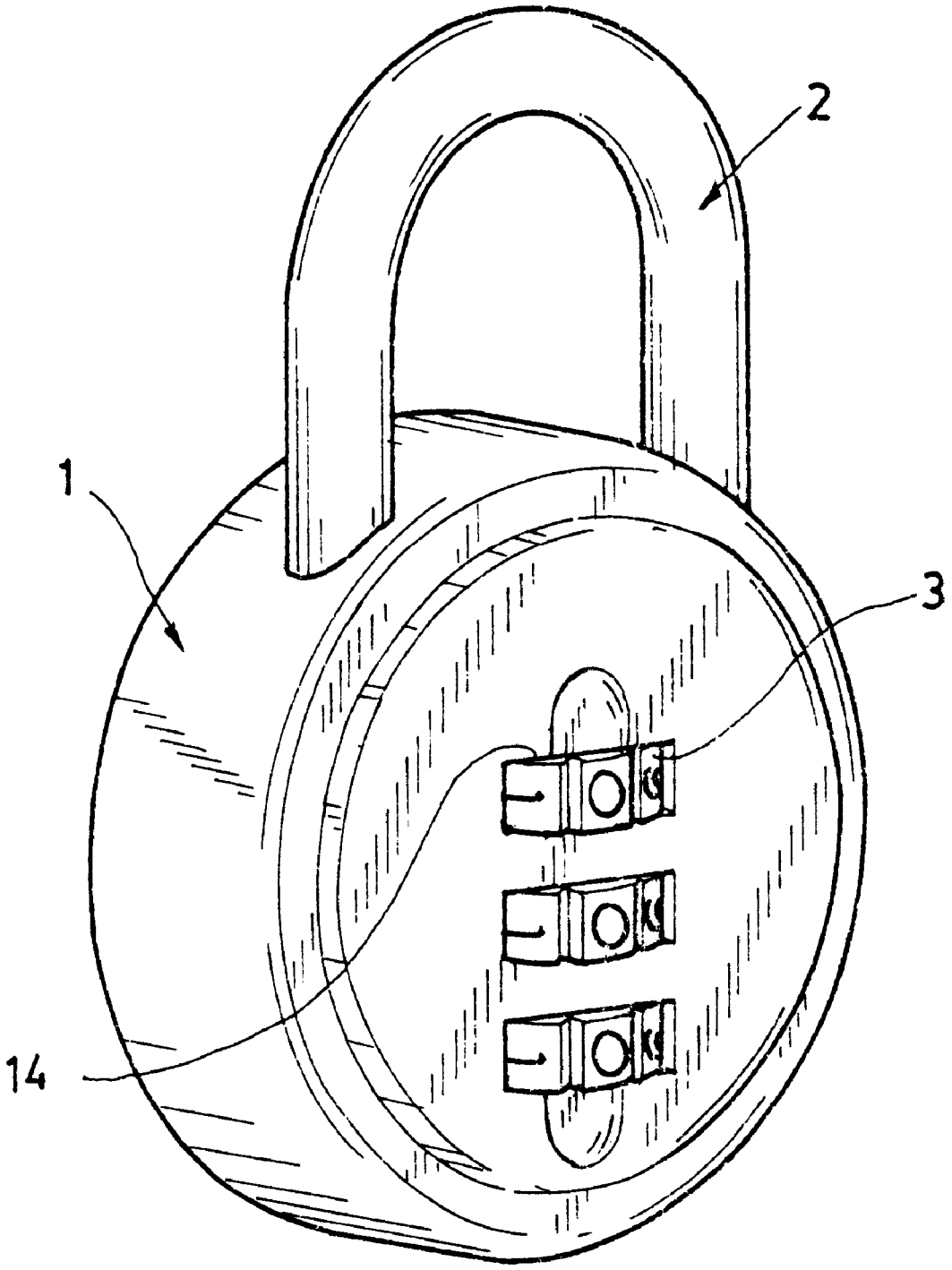
FIG. 1 is a perspective view of the present invention.
Figure 2:
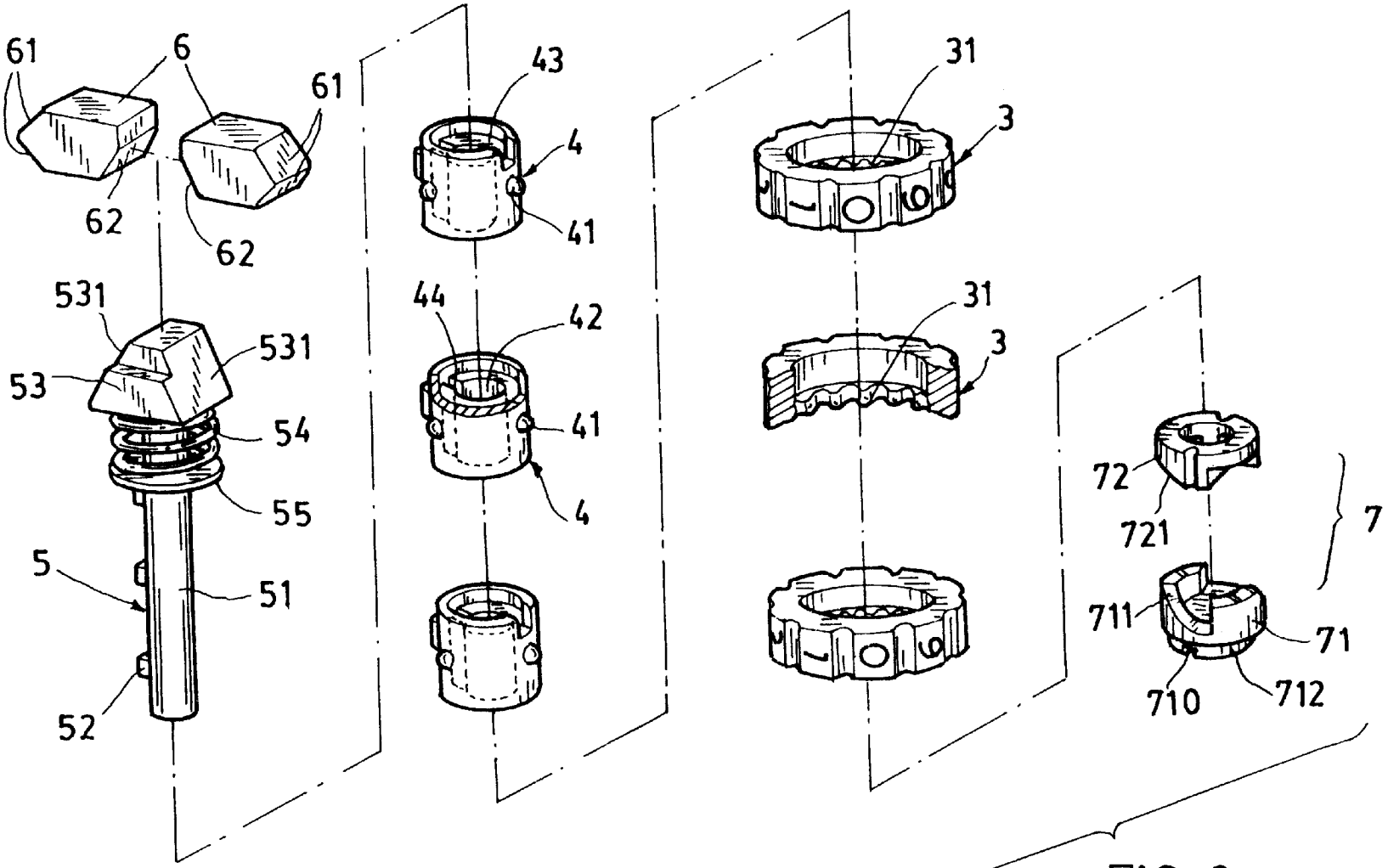
FIG. 2 is an exploded view of the present invention.
Figure 3:
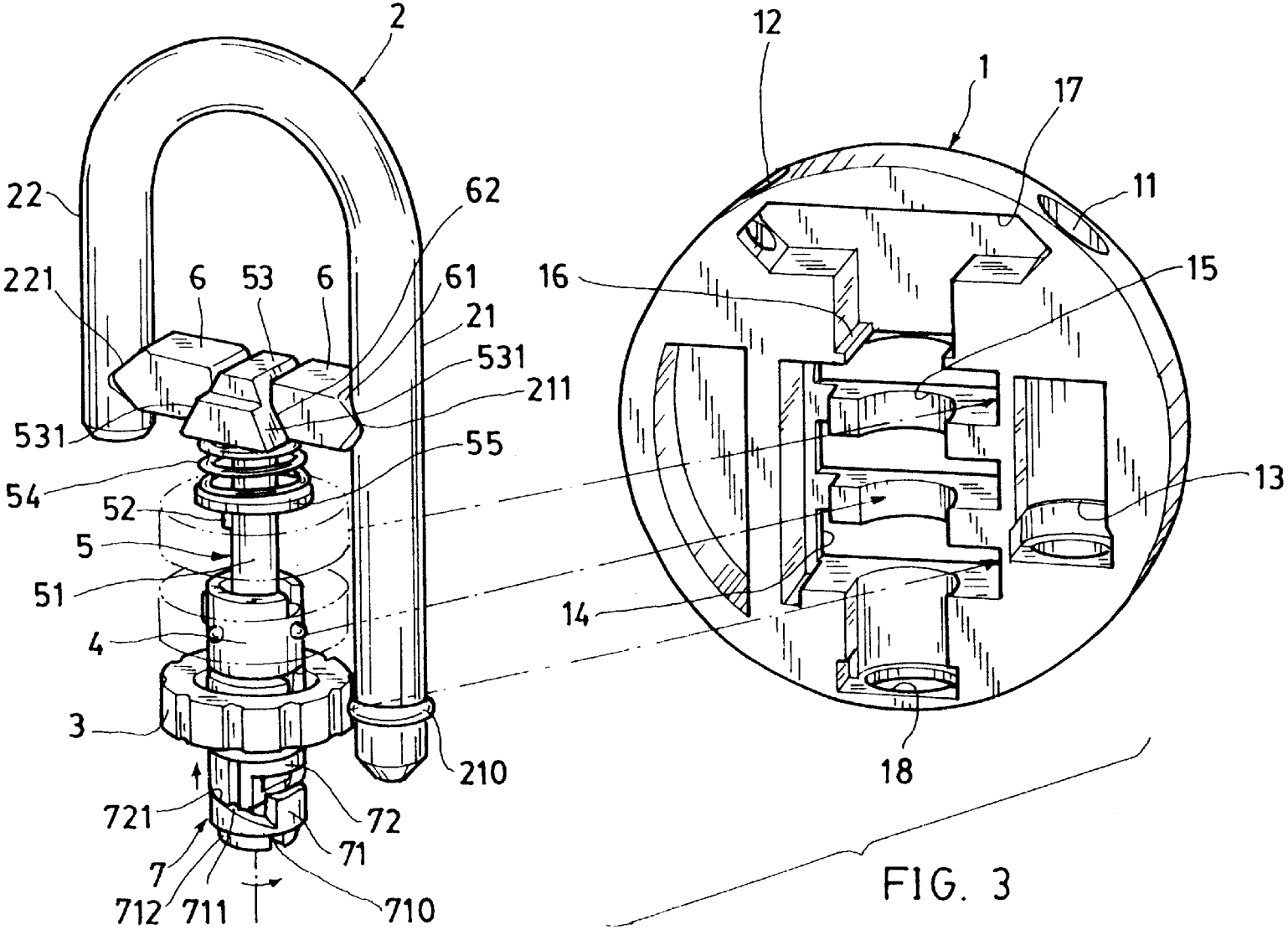
FIG. 3 is an illustration showing the present invention as disassembled.

As shown in FIGS. 1–7, the present invention comprises: a casing 1, a shackle 2 formed as an inversed U shape movably secured or pivotally secured in the casing 1, a plurality of dials 3 and sleeves 4 rotatably mounted on a locking shaft 5 having a bolt 51 longitudinally provided in the casing 1, a pair of locking shuttles 6 transversely slidable in the casing for locking or unlocking the shackle 2, and a combination changing means 7 formed in a bottom portion of the casing 1 below the bolt 51. Even though the casing 1 is generally circular shaped as shown in FIG. 1, the shapes of the present invention are not limited.

The casing 1 is formed with a long-leg hole 11 and a short-leg hole 12 in opposite sides of the casing 1 for slidably engaging a long leg member 21 and a short leg member 22 respectively in the two holes 11, 12; a lower annular socket 13 and an upper annular socket 131 formed in the casing 1 adjacent to the long-leg hole 11 for respectively engaging a retainer 210 resiliently held on a lower portion of the long leg member 21 when the shackle 2 is locked or unlocked in the casing, a plurality of dial slots 14 notched in the casing 1 for protruding the dials 3 outwardly through the dial slots 14 for rotating the dials 3, a plurality of sleeve holding portions 15 for rotatably holding the sleeves 4 therein, and a retaining portion 16 formed in an upper portion of the casing 1 for holding a spring washer 55 of the bolt 51 on the retaining portion 16, a guiding groove 17 transversely formed in an upper portion of the casing 1 for slidably engaging the two locking shuttles 6 in the groove 17, and a combination-changing hole 18 formed in a bottom of the casing below the bolt 51.

The long leg member 21 and the short leg member 22 of the shackle 2 are respectively formed with a pair of V-shaped notches 211, 221 in two inner portions of the two leg members 21, 22 for respectively engaging a pair of V-shaped wedge portions 61 respectively formed on the two shuttles 6.

Each sleeve 4 includes: a plurality of protrusions 41 circumferentially formed on a cylindrical surface of the sleeve 4 each protrusion 41 engageable with each of a plurality of recesses 31 annularly recessed in an inside wall of each dial 3 for coupling each sleeve 4 with each dial 3 for a simultaneous rotation of the dial 3 and the sleeve 4, a central hole 42 formed through the sleeve 4 for rotatably engaging the bolt 51 in the central hole 42, an annular extension 43 annularly formed on an inside wall of the sleeve 4 for retarding a downward movement of a projection 52 formed on the bolt 51 when locking the padlock, and a slot 44 formed through the annular extension 43 for passing the projection 52 of the bolt 51 through the slot 44 when unlocking the padlock by downwardly depressing the bolt 51.

The locking shaft 5 includes: a bolt 51 defining an axis 50 longitudinally formed at a central portion of the casing 1, a plurality of projections 52 equally spaced and formed on the bolt 51, a conical head portion 53 formed on a top of the bolt 51 having a pair of sloping surfaces 531 respectively disposed on opposite sides of the conical head portion 53, each sloping surface 531 tapered upwardly towards the axis 50 of the bolt 51, a tensioning spring 54 resiliently held between the conical head portion 53 and a spring washer 55 retained on the retaining portion 16 in the casing 1 for resiliently urging the conical head portion 53 upwardly for thrusting the two shuttles 6 sidewardly for locking the two leg members 21, 22 of the shackle 2.

Each locking shuttle 6 includes: a V-shaped wedge portion 61 formed on an outer end portion of the shuttle to be engageable with each V-shaped notch 211, 221 formed in each leg member 21, 22 of the shackle 2, and an inner sloping surface 62 formed on an inner end portion of the shuttle 6 tapered upwardly towards the axis 50 of the bolt 51 and engageable with a sloping surface 531 formed on the conical head portion 53 of the bolt 51, whereby upon locking of the padlock, the two sloping surfaces 531 on the conical head portion 53 as resiliently urged upwardly will thrust the two inner sloping surfaces 62 of the two shuttles 6 to outwardly extend the two shuttles 6 for engaging the V-shaped notches 211, 221 of the two leg members 21, 22 for locking the shackle 2 within the casing 1.

The combination changing means 7 includes: a driving wheel 71 having a sloping cam surface 711 formed on a perimeter of the driving wheel 71, and a driving notch 710 recessed in a stem 712 formed on a lower portion of the driving wheel 71 and rotatably held in a bottom hole 18 formed in the casing 1; and a follower wheel 72 rotatably held in the casing 1 below the sleeves 4 and positioned above the driving wheel 71 having a follower sloping surface 721 formed on a peripheral cam portion of the follower wheel 72 to be tangentially engageable with the sloping cam surface 711 on the driving wheel 71, whereby upon a rotation (R) of the driving wheel 71 by a tool or a coin inserted into the driving notch 710 to allow the sloping cam surface 711 to upwardly thrust (p) the follower sloping surface 721, the sleeves 4 will be raised to be disengaged from the dials 3 when the padlock is unlocked (FIG. 7) to allow a free rotation of the dials for resetting a new combination, while each sleeve 4 having its slot 44 engaged with the projection 52 on bolt 51 is thereby locked to allow the free rotation of each dial 3 for changing the combination.

Figure 4:
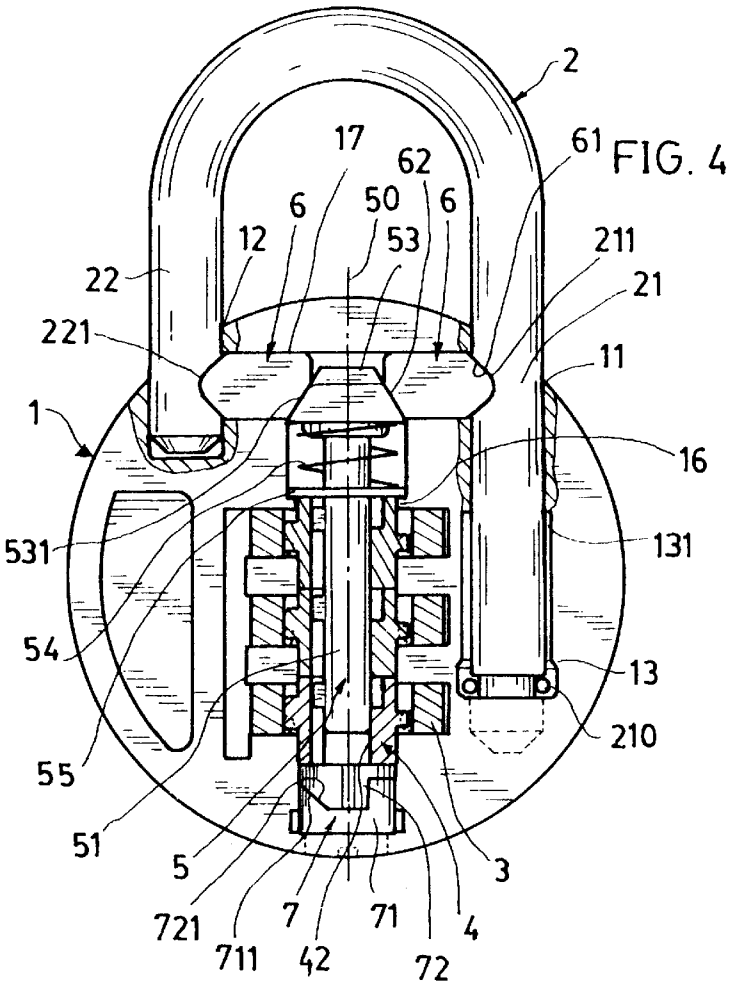
FIG. 4 is a partial sectional drawing which is unlockable.
Figure 5:
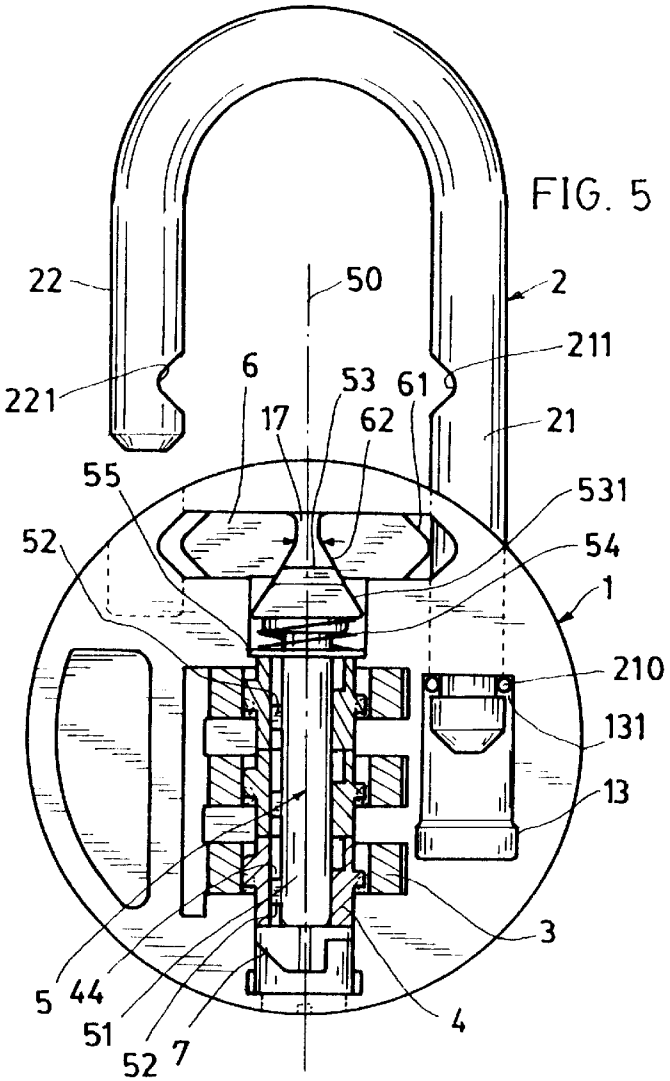
FIG. 5 is an illustration of the present invention when pulling the shackle upwardly for unlocking the padlock.
Figure 7:
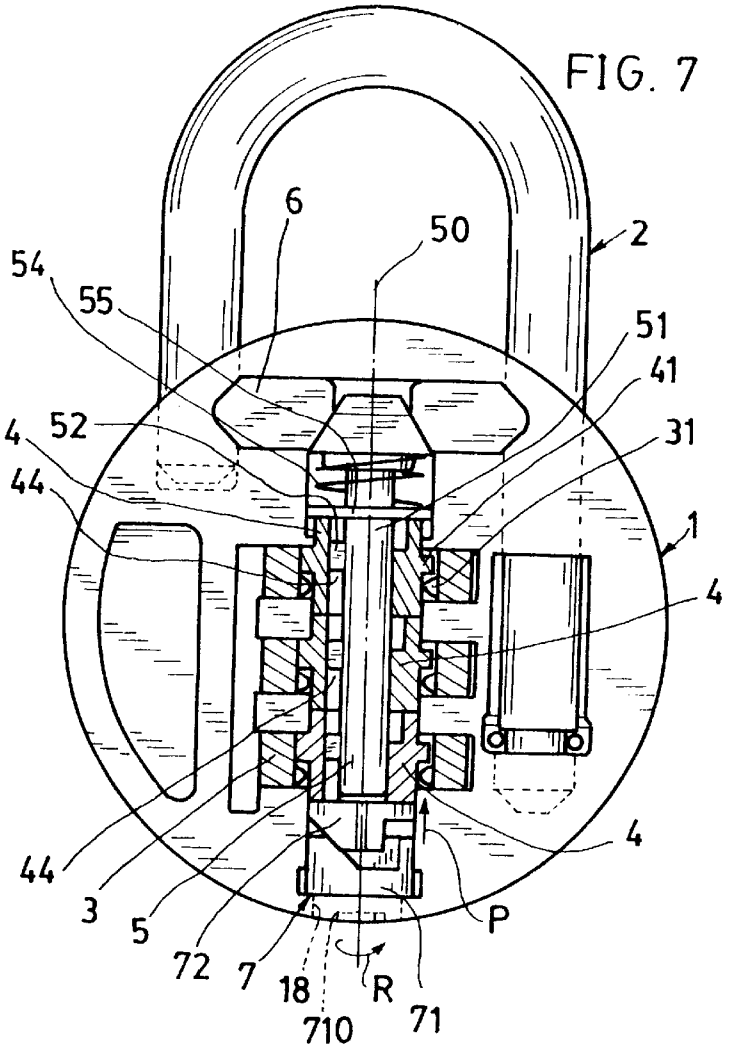
FIG. 7 is an illustration of the present invention for changing a combination.
Figure 9:
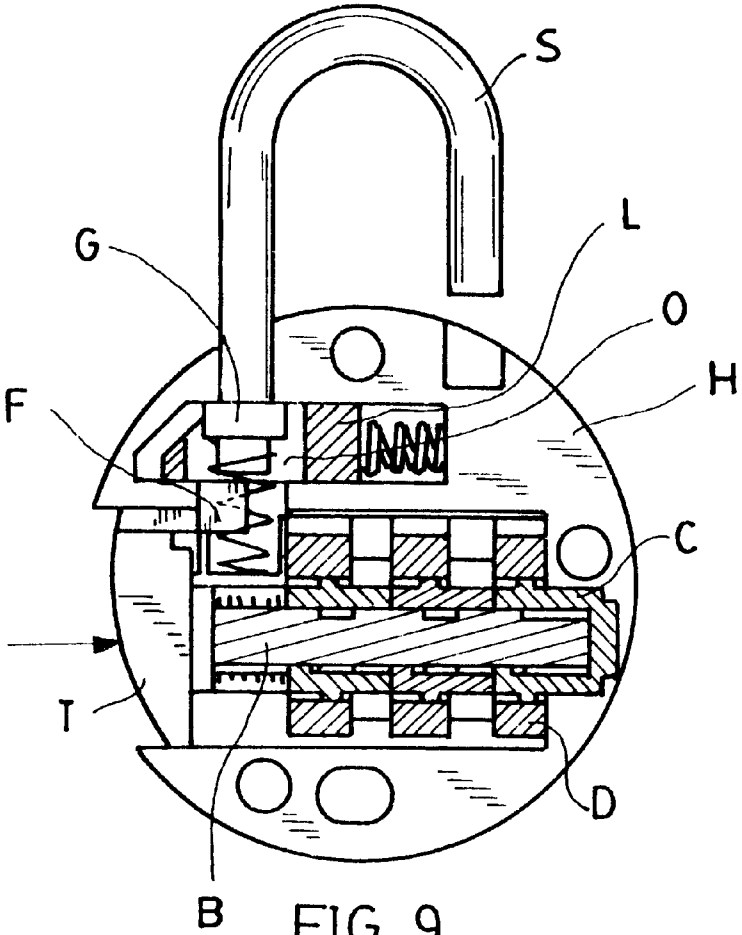
FIG. 9 PRIOR ART
FIG. 9 shows the conventional padlock when unlocked.
Figure 8:
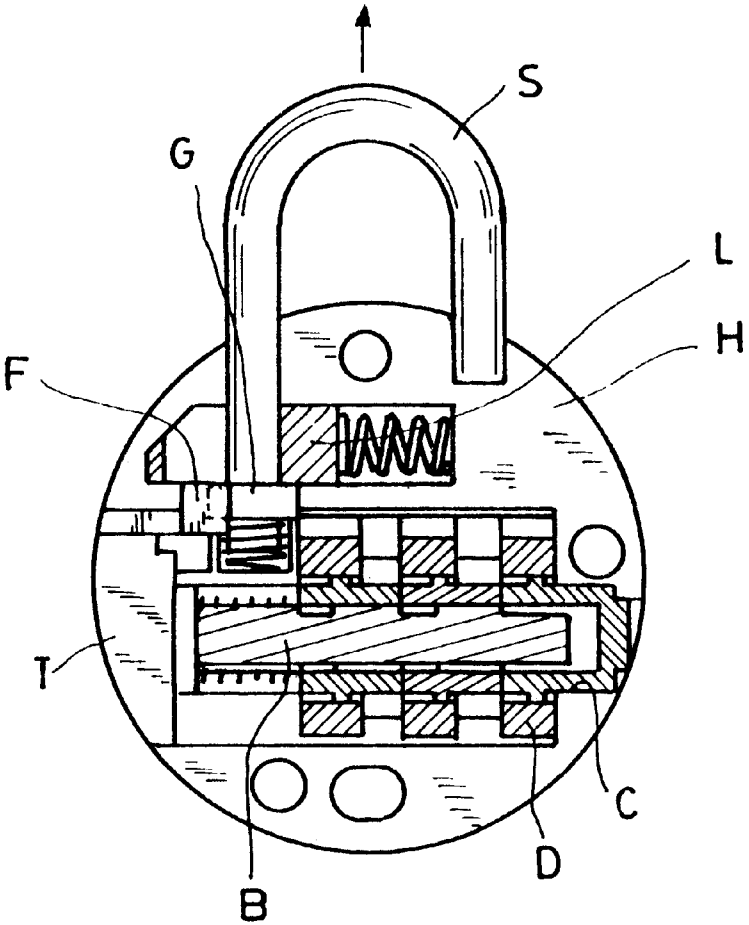
FIG. 8 PRIOR ART
FIG. 8 shows a conventional padlock when locked.

When resetting the combination as shown in FIG. 7 by unlocking the padlock, the sleeves 4 will urge the spring washer 55 upwardly to compress the spring 55 to store its spring energy, thereby allowing a restoring of the spring 55 to restore the follower wheel 72 downwardly from FIG. 7 to FIG. 4 when releasing the tool from the notch 710.

Figure 6:
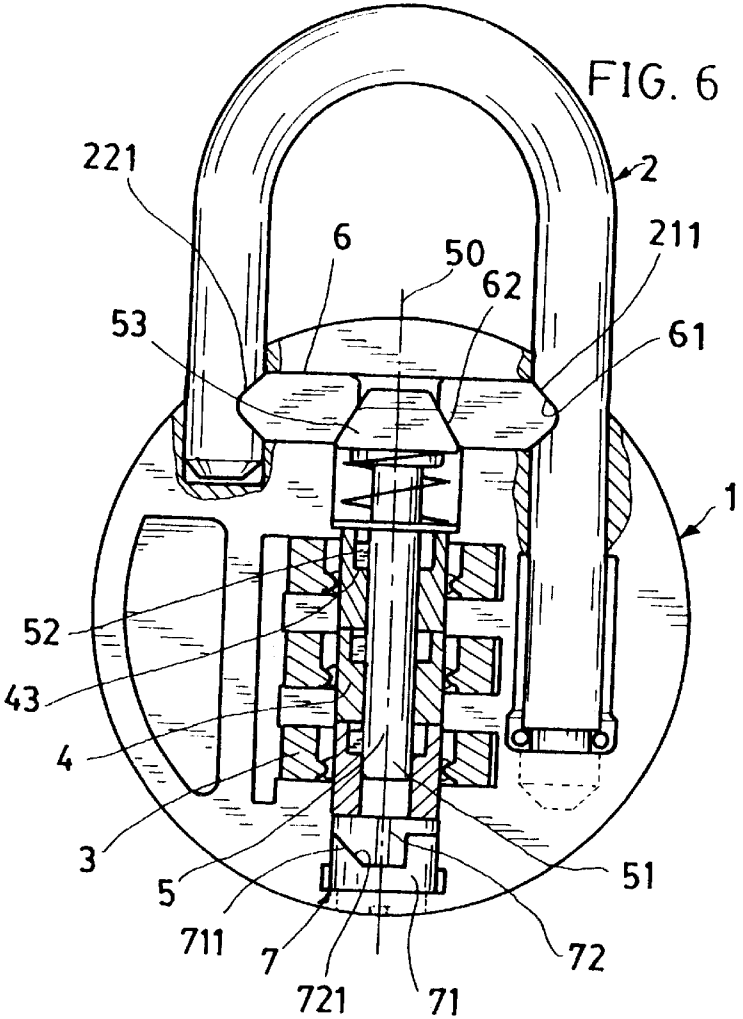
FIG. 6 is a sectional drawing of the present invention when locked.

For locking the present invention as shown in FIG. 6 by rotating the dials and sleeves to any locking combination, the projection 52 on the bolt 51 will then be retarded by the annular extension 43 formed on each sleeve 4. Upon an upward pulling of the shackle 2 trying to open the padlock, the shuttles 6 will be inwardly retracted as urged by the V-shaped notches 211, 221 to thrust the conical head portion 53 downwardly. However, the bolt 51 is now retarded by the sleeve extension 43 and the conical head portion 53 is not downwardy depressible; and the shuttles 6 are not retractable, thereby deadly locking the notches 211, 221 to lock the shackle 2 in the casing 1.

When unlocking the padlock of the present invention by rotating the dials and sleeves to a correct unlocking combination as shown in FIG. 4, each sleeve 4 is rotated to align the slot 44 formed through the annular extension 43 with each projection 52 formed on the bolt 51 so that the annular extension 43 will no longer retard the bolt 51. Upon an upward pulling of the shackle 2 (from FIG. 4 to FIG. 5), the V-shaped notches 211, 221 on the leg members 21, 22 of the shackle 2 will thrust the shuttles 6 inwardly to depress the concial head portion 53 and the bolt 51 downwardly. Since the bolt 51 is now downwardly depressible and not retarded by the extension 43 of the sleeve 4 and the shuttles are retractable without locking the shackle 2, the shackle is therefore upwardly pulled for unlocking the padlock.

The present invention eliminates a locking block and a push button as found in a conventional padlock to simplify its structure and mechanism. The locking and unlocking operation is so easy and convenient. The combination changing operation is also very easy, thereby being superior to the conventional padlock.

The elements or mechanism in construction of the present invention may also be made as a module for an easy assembly or maintenance.

The present invention may be modified without departing from the spirit and scope of the present invention. For instance, the notch 211, 221 may also be formed as semi-circular or other shapes.

I claim:

1. A combination padlock comprising:

a casing;

a shackle having a long leg member and a short leg member respectively engageable with two leg holes formed in said casing, each said leg member having a notch recessed in an inner portion of said leg member;

a plurality of dials and sleeves coupled with one another and rotatably mounted on a bolt of a locking shaft which is longitudinally held in the casing;

a pair of locking shuttles transversely slidably held in said casing and each said locking shuttle inwardly engaged with said locking shaft and outwardly engaged with each said notch recessed in each said leg member of said shackle for locking said shackle in said casing; said locking shaft including: the bolt defining an axis longitudinally formed at a central portion of the casing, a plurality of projections equally spaced and formed on the bolt which is downwardly retarded by said sleeves when locking the padlock, and downwardly depressed to pass through the sleeves when unlocking the padlock, a conical head portion formed on a top of the bolt having a pair of sloping surfaces respectively disposed on opposite sides of the conical head portion to contact the two shuttles, each said sloping surface tapered upwardly towards the axis of the bolt, and a tensioning spring resiliently held between the conical head portion and a spring washer retained on a retaining portion in the casing for resiliently urging the conical head portion upwardly for thrusting the two shuttles sidewardly for locking the two leg members of the shackle; and a combination changing means provided in said casing for resetting a new combination for unlocking said padlock; said combination changing means including: a driving wheel having a sloping cam surface formed on a perimeter of the driving wheel, and a driving notch recessed in a stem formed on a lower portion of the driving wheel and rotatably held in a bottom hole formed in the casing; and a follower wheel rotatably held in the casing below the sleeves and positioned above the driving wheel having a follower sloping surface formed on a peripheral cam portion of the follower wheel to be tangentially engageable with the sloping cam surface on the driving wheel, whereby upon a rotation of the driving wheel to allow the sloping cam surface to upwardly thrust the follower sloping surface of the follower wheel, the sleeves will be raised to be disengaged from the dials when the padlock is unlocked to allow a free rotation of the dials for resetting a new combination.

* * * * *